US005772035A

United States Patent [19]

Harrison

[11] Patent Number: 5,772,035

[45] Date of Patent: Jun. 30, 1998

[54] ROLL AND TUCK BAGS

[75] Inventor: Grady L. Harrison, Longview, Tex.

[73] Assignee: TC Manufacturing Co., Inc., Evanston, Ill.

[21] Appl. No.: 899,406

[22] Filed: Jul. 23, 1997

Related U.S. Application Data

[63] Continuation of Ser. No. 746,929, Nov. 18, 1996, abandoned.

[51] Int. Cl.[6] ..... B65D 33/16

[52] U.S. Cl. ..... 206/554; 53/469; 206/260; 383/87

[58] Field of Search ..... 53/469, 480, 482; 206/260, 554; 383/85, 86, 87

[56] References Cited

U.S. PATENT DOCUMENTS

| | | | |
|---|---|---|---|
| 438,798 | 10/1890 | Burgridge | 383/87 |
| 578,243 | 3/1897 | Keith | 383/87 |
| 830,148 | 9/1906 | Harvey et al. | 383/87 |
| 1,992,152 | 2/1935 | Yeates | 206/260 |
| 2,033,994 | 3/1936 | Mulligan . | |
| 2,053,085 | 9/1936 | Hunter . | |
| 2,061,613 | 11/1936 | Cowgill et al. . | |
| 2,709,467 | 5/1955 | Hoeppner | 383/87 |
| 3,117,712 | 1/1964 | Kugler . | |
| 3,358,906 | 12/1967 | Faiers | 383/86 |
| 3,469,769 | 9/1969 | Guenther | 383/87 |
| 3,647,060 | 3/1972 | Kiely | 383/87 |
| 3,768,230 | 10/1973 | Bruno | 383/87 |
| 4,332,347 | 6/1982 | Clayton . | |
| 4,408,643 | 10/1983 | Laske et al. . | |
| 4,515,840 | 5/1985 | Gatward . | |
| 5,100,000 | 3/1992 | Huseman | 206/554 |

*Primary Examiner*—Stephen P. Garbe
*Attorney, Agent, or Firm*—Lee, Mann, Smith, McWilliams, Sweeney & Ohlson

[57] ABSTRACT

A roll and tuck plastic bag designed to effectively seal an item having a bottom pocket opening upwardly on one side of a web and an upper pocket on the other side of the web opening downwardly whereby the bottom pocket containing an item is rolled up to the upper pocket which is inverted and tucked over the filled bottom pocket to provide a simple, tight and concise package.

10 Claims, 2 Drawing Sheets

ROLL AND TUCK BAGS

This application is a continuation of application Ser. No. 08/746,929, filed Nov. 18, 1996 now abandoned.

FIELD OF THE INVENTION

The present invention relates generally to plastic bags which are used to contain food items and the like and are conventionally used in supermarkets and fast food stores. More specifically, the invention relates to an improved type of a plastic bag which is capable of providing a simple, tight and concise package substantially sealing the item carried therein without the use of adhesive, seals, zippers and the like.

BACKGROUND OF THE INVENTION

Plastic bags of all types are used in stores such as supermarkets and fast food outlets to hold all kinds of products including those that are hot or cold, wet or dry, loose or packaged, and so on. Plastic bags for these purposes are very popular because of their low cost and their ease of use. However, users of these bags can face some problems with sealing or containing the items within the bag in a simple manner without additional ties or adhesives.

The plastic bags that are normally used today in supermarkets and the like are frequently what is called a T-shirt bag which is pulled open, the items are placed in the bag, and the bag is then carried by the customer using the handles at the top of the bag. There is nothing to stop the items in the bag from falling out. Other types of bags have openings at the top which can be sealed so that an item placed in the bag can be protected and will not fall out. Seals are provided by adhesive tapes, adhesive surfaces, plastic zippers and the like.

See, for example, U.S. Pat. Nos. 5,419,437; 4,846,568; 4,290,467; 4,586,319 and 4,665,552. However, any time a seal of any type is added to a plastic bag, another item of cost is added in making the bag. Moreover, to affect the seal, an extra step must be taken by the user to apply the adhesive tape or close the adhesive surfaces or the sides of a plastic zipper.

Of course, if the items are food products which are either hot or cold, wet or dry, loose or packaged, it is really quite important that the bag containing these items be effectively but simply sealed to protect them from contact with other items or from simply falling out.

Since plastic bags of the nature disclosed are frequently used in large supermarkets and fast food outlets where numerous items are being handled by a checkout clerk as expeditiously as possible due to lines which often form at checkout counters in such stores, it is really quite important to provide a plastic bag which can quickly be used and is reliable but simple for closure purposes to protect the items from falling out of the bag or from contacting other items which may be in some other carrying container such as a T-shirt bag.

SUMMARY OF THE INVENTION

It is an object of this invention to provide a plastic bag construction which overcomes the disadvantages of the prior art as described above. It is specifically contemplated that the plastic bag construction of this invention will overcome the disadvantages recited herein with respect to the prior art while providing a simple construction which is literally no more expensive in production than a single bag type.

In broad terms the plastic bag construction of this invention contemplates a food product bag or any other kind of product bag which has at least two pockets. The pockets are located on opposite sides of the bag at the end and tops thereof with the pockets being spaced from each other some distance. One pocket of the bag is at the bottom of the bag structure opening up toward the user. This pocket is on one side of the bag construction. The second pocket is located at the top end of the bag but is on the opposite or backside of the bag with the mouth of the bag opening downwardly. The two pockets are separated by some distance by a web of plastic. The bottom pocket is used to contain a particular food item or for that matter, any other kind of item. The size of the pocket, of course, will depend upon the items which are to be placed therein. If the pocket is designed to contain such an item as a sandwich, it can be reasonably small, whereas if the pocket is to hold something like a broiled chicken, it would be much larger. The actual dimensions of the pockets are determined by the end use thereof and can be readily varied in size.

As stated, the bottom pocket is used to contain an item, probably a food item. The top pocket on the reverse side of the bag is used as a "keeper" to contain the food product in the bottom bag. Once an item such as a food item is placed in the bottom bag, the bottom bag is rolled upwardly toward the top pocket. When the bottom pocket roll reaches the top of the bag, the top pocket which is located on the backside of the bag, is turned "inside out" and tucked over the rolled up food item. The package is now in a tight concise form held together by the top "keeper" pocket without the use of any seals, zippers or the like.

Bags of this type may be made in many different formats. For example, the bag may be in a header format which would provide a bag pack sealed at the top at the header so that the bags can simply be torn off at lines of perforation as shown in the drawings or as shown in U.S. Pat. No. 5,575,393. Additionally, the bags may be made in a saddle conformation in which there are two bags separated by a header which are then configured in a bag pack form and the bag pack is hung over some sort of a plastic bag holder such as an A-frame or the like (see U.S. Pat. No. 5,100,000). It is also possible that the bags can be constructed in a simple bundle form of a loose style arrangement so that they may simply be picked up and used. All of these are conventional constructions are well known to producers and users of plastic bags.

The plastic bags are made of a plastic resin mix generally a polyethylene of a specified thin gauge. The bags may be made either from sheeting or tubes of plastic film, both of which are conventional in plastic bag production.

The pockets themselves may be made by heat sealing the plastic material around the edges of the bag or the pockets may have gussets which would allow for a larger item.

BRIEF DESCRIPTION OF THE DRAWINGS

The above mentioned and other features of this invention and the manner of obtaining them will become more apparent and the invention itself will be best understood by reference to the following description of an embodiment of the invention taken in conjunction with the accompanying drawings in which.

DESCRIPTION OF THE PREFERRED EMBODIMENT

Figure 1:
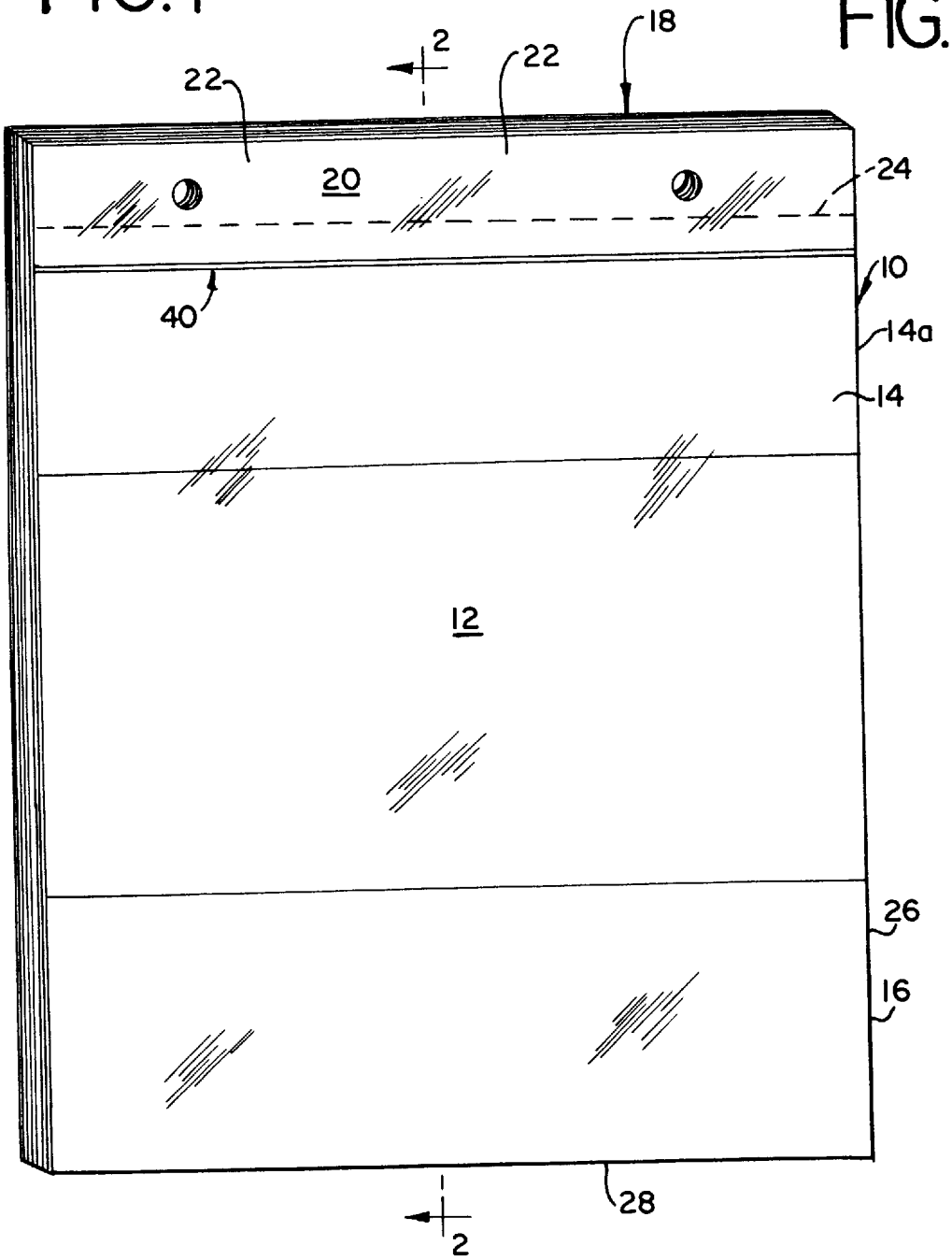
FIG. 1 is a perspective view of the plastic bag of this invention in a header format wherein there is a pad of bags.
Figure 2:
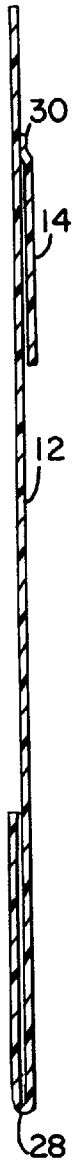
FIG. 2 is a sectional view taken along lines 2—2 of FIG. 1.

The plastic bag 10 of this invention as shown in FIGS. 1 and 2 includes a web 12 to which are attached two bag pockets 14 and 16. As shown in FIG. 1 and more clearly in FIG. 2 bag pocket 14 is attached on the back of the web 12 whereas bag pocket 16 is attached on the front of the web 12. In the construction shown in FIG. 1 the plastic bag of this invention is in a headered construction 18. In such a construction a plurality of the plastic bags are assembled in a bag pad construction with a header 20 at the top. The headers of the various bags are attached together by header seals 22 which may be heat seals or other mechanical seals as is well known in the plastic bag art.

The header 20 is provided with a line of weakening or perforation 24 so that the individual bags 10 can be removed from the header for use.

The plastic bag 10 of this invention is made in a conventional fashion wherein either tube or flat stock is used. The bag 16 is attached by heat sealing at the edges 26 and bottom 28 or the plastic film may be folded upon itself to create the bottom 28. The plastic bag 14 is in like fashion heat sealed 14*a* to the web 12 and also along its top 30.

This provides a very simple construction for a plastic bag which does not include any additional fasteners or adhesives for the use of the bag in its sealing capacity.

Figure 3:
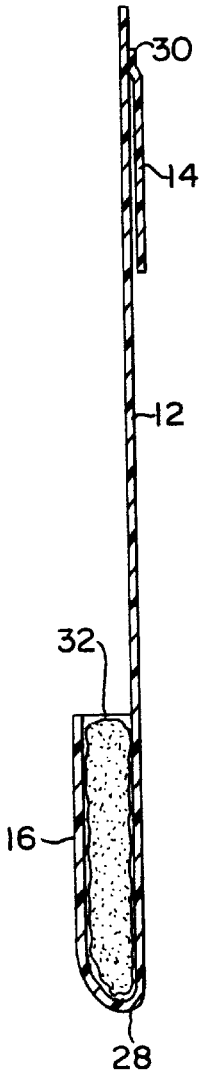
FIG. 3 is a sectional view similar to FIG. 2 except that the bottom bag is filled.
Figure 4:
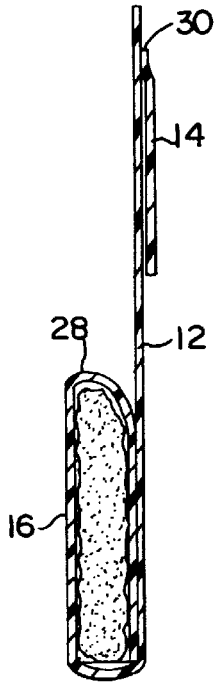
FIG. 4 is a sectional view similar to FIG. 3 except that the bottom bag has been partially rolled up toward the top bag.
Figure 5:
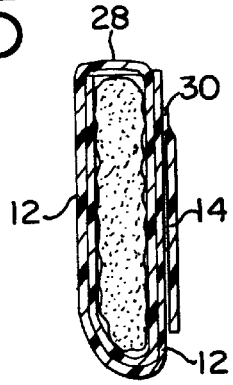
FIG. 5 is a sectional view showing the bottom bag fully rolled up to the top.
Figure 6:
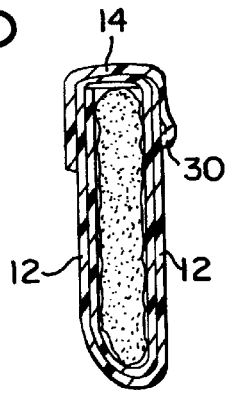
FIG. 6 is a sectional view similar to FIG. 5 wherein the top or keeper pocket has been turned inside out and tucked over the rolled up bottom bag.

Referring now to FIGS. 2, 3, 4, 5 and 6 which show the operation of the bag in a step wise fashion. FIG. 2 shows the bag with the bottom pocket 16 empty. FIG. 3 shows the bag with the bottom pocket 16 filled with a product 32. FIG. 4 shows the bag with the bottom pocket 16 rolled once up the web 12. FIG. 5 shows the bag with the bottom pocket rolled completely up to the top of the web with the backside pocket 14 still in its original position. FIG. 6 shows the bag of this invention with the backside pocket 14 inverted and tucked over the rolled up food 32 item in the bottom bag 16. In this condition it can be seen that in FIG. 6 the food item 32 is completely protected by the plastic bottom bag 16 and the inverted backside pocket 14 so that it will not leak or fall out of the bag. The product is completely secure within the folded over bag pocket 14 and there is no need for any additional adhesive or any tie to maintain the item in that condition.

This simple construction allows an operator in a supermarket or fast food outlet to completely package food items and the like, hot or cold, wet or dry, in a very simple maneuver to provide a very secure package which will not leak or allow the product to fall out. Prior art constructions have required adhesives or ties to reach this condition, or in some instances, there have been several flaps which have had to be folded in various directions with stiffeners and the like. None of these are required for the simple construction on the bag of this invention.

While in the foregoing specification this invention has been described in relation to a preferred embodiment thereof. It will be apparent to those skilled in the art that the invention is susceptible to additional embodiments and that certain of the details described herein can be varied considerably without departing from the basic principals of the invention.

I claim:

1. A package for carrying and substantially sealing an item carried therein without the use of adhesive, seals, zippers or other fasteners comprising:

(a) an elongated web having a top edge, a bottom edge and two side edges; and (b) a first bag portion positioned adjacent said bottom edge of said web and secured thereto at its sides and bottom and having a mouth opening toward said top edge of said web; and (c) a second bag portion spatially positioned upwardly from said first bag portion on the opposite side of said web and secured thereto at its sides and top and having a mouth opening toward said bottom edge of said web; and (d) said first bag portion, containing the item to be carried, having been rolled up toward said top edge to a position substantially opposite said second bag portion; and (e) said second bag portion having been inverted and tucked over said rolled up bag portion to provide a substantially secure package.

2. The package of claim 1 wherein said second bag portion is positioned adjacent the top edge of said web.

3. The package of claim 2 wherein said rolled up first bag portion is positioned substantially level with said second bag portion when said second bag portion is inverted and tucked over said first bag portion.

4. The package of claim 3 wherein said first bag portion is spaced on said web a sufficient distance from said second bag portion to allow said first bag portion to be rotated at least twice as it is rolled toward said second bag portion.

5. A bag pack comprising a plurality of roll and tuck bags each attached by a line of weakening to a header and said headers attached to each other by seals said bags comprising:

(a) an elongated web having a top edge, a bottom edge and two side edges; and (b) a first bag portion positioned adjacent said bottom edge of said web and secured thereto at its sides and bottom and having a mouth opening toward said top edge of said web; and (c) a second bag portion spatially positioned upwardly from said first bag portion on the opposite side of said web and secured thereto at its sides and top and having a mouth opening toward said bottom edge of said web;

(d) whereby said first bag portion after filling can be rolled upwardly toward said second bag portion and said second bag portion can be inverted and tucked over said rolled up first bag portion to provide a substantially secure package.

6. The bag pack of claim 5 having a plurality of roll and tuck bags attached by a line of weakening on both sides of said headers to create a saddle of said bags.

7. The method of forming a package for carrying and substantially sealing an item carried therein without the use of adhesives, seals, zippers or other fasteners comprising the steps of:

(a) forming an elongated web having a top edge, a bottom edge and two side edges with a first bag portion adjacent said bottom edge and secured thereto at its sides and bottom and having a mouth opening toward said top edge and with a second bag portion spatially positioned upwardly from said first bag portion on the opposite side of said web and secured thereto at its sides and top and having a mouth opening toward said bottom edge of said web;

(b) placing an item to be carried in said first bag portion;

(c) rolling said first bag portion upwardly toward said top edge to a position substantially opposite said second bag portion; and (d) inverting and tucking said second bag portion over said rolled up bag portion to provide a substantially secure package.

8. The method of claim 7 wherein said second bag portion is positioned adjacent the top edge of said web.

9. The method of claim 8 wherein said rolled up first bag portion is positioned substantially level with said second bag portion when said second bag portion is inverted and tucked over said first bag portion.

10. The method of claim 9 wherein said first bag portion is spaced on said web a sufficient distance from said second bag portion to allow said first bag portion to be rotated at least twice as it is rolled toward said second bag portion.

* * * * *